US005642527A

United States Patent [19]

Savage

[11] Patent Number: 5,642,527

[45] Date of Patent: Jul. 1, 1997

[54] GLOVE SANDER

[76] Inventor: Craig P. Savage, 3513 Aster La., Rowlett, Tex. 75088

[21] Appl. No.: 599,333

[22] Filed: Feb. 9, 1996

[51] Int. Cl.[6] ..... A41D 19/00

[52] U.S. Cl. ..... 2/161.8; 2/161.6; 2/167; 2/158; 2/159

[58] Field of Search ..... 2/158, 159, 160, 2/161.6, 161.8, 167

[56] References Cited

U.S. PATENT DOCUMENTS

| | | | |
|---|---|---|---|
| 1,286,771 | 12/1918 | Raymond | 2/158 |
| 2,702,906 | 3/1955 | Causse | 2/159 |
| 3,748,792 | 7/1973 | Lamb | 2/161.8 |
| 4,884,374 | 12/1989 | Natale et al. | 2/161.8 |
| 5,134,746 | 8/1992 | William | 15/227 |
| 5,367,711 | 11/1994 | Calagui | 2/161.6 |

FOREIGN PATENT DOCUMENTS

| | | | |
|---|---|---|---|
| 2210362 | 7/1974 | France | 2/161.8 |

*Primary Examiner*—Bibhu Mohanty

[57] ABSTRACT

A glove sander including a glove that has a top section and a palm section. The top section is formed of a flexible fabric that has an abrasive layer and an outer layer, an inner layer, and a lining therebetween. The palm section of the glove is formed of a flexible fabric that has an abrasive layer and an outer layer, an inner layer, and a liner. Included is top stitching that is used to attach the palm section to the top section. The top stitching forms an interior area capable of encasing a hand of a wearer. Lastly, a wrist cover is formed when the top section and the palm section are attached by the top stitching. The wrist cover allows access to the interior area of the glove. The wrist cover has a pair of side vents that are formed near the cover. The pair of side vents are formed when the top stitching ends along the outer edge.

3 Claims, 3 Drawing Sheets

GLOVE SANDER

BACKGROUND OF THE INVENTION

1. Field of the Invention

The present invention relates to a glove sander and more particularly pertains to providing a sanding glove that is formed of flexible material and has sanding material disposed thereabout, and further providing reinforced edges of the glove for allowing the user to sand within crevices.

2. Description of the Prior Art

The use of an abrasive glove is known in the prior art. More specifically, abrasive gloves heretofore devised and utilized for the purpose of abrading contact with an object are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 256,183 to Kupperman et al. discloses an abrasive glove. U.S. Pat. No. 4,038,787 to Bianchi discloses an abrasive glove. U.S. Pat. No. 3,748,792 to Lamb discloses a sanding glove. U.S. Pat. No. 3,643,386 to Grzyll discloses an abrasive apparel. Lastly, U.S. Pat. No. 3,151,333 to Scholz discloses an abrasive surfaced glove.

While these devices fulfill their respective, particular objectives and requirements, the aforementioned patents do not describe glove sander that allows a sanding job to be simplified and made quicker by using the present invention on the hand for sanding of any sandable material, including being able to sand in crevices with reinforced edges of the glove sander.

In this respect, the glove sander according to the present invention substantially departs from the conventional concepts and designs of the prior art, and in doing so provides an apparatus primarily developed for the purpose of providing a sanding glove that is formed of flexible material and has sanding material disposed thereabout, and further providing reinforced edges of the glove for allowing the user to sand within crevices.

Therefore, it can be appreciated that there exists a continuing need for a new and improved glove sander which can be used for providing a sanding glove that is formed of flexible material and has sanding material disposed thereabout, and further providing reinforced edges of the glove for allowing the user to sand within crevices. In this regard, the present invention substantially fulfills this need.

SUMMARY OF THE INVENTION

In view of the foregoing disadvantages inherent in the known types of abrasive glove now present in the prior art, the present invention provides an improved glove sander. As such, the general purpose of the present invention, which will be described subsequently in greater detail, is to provide a new and improved glove sander and method which has all the advantages of the prior art and none of the disadvantages.

To attain this, the present invention essentially comprises a glove that has top section and a palm section. The top section of the glove is formed of a flexible fabric that has a top abrasive layer and an inner layer and an outer layer with a thin quilted lining therebetween. The top abrasive layer covering about ninety percent of the outer layer of the top section. The top section of the glove has a proximal end, a distal end, and a thumb cover. The distal end of the top section has a tapered front edge. The palm section of the glove is formed of a flexible fabric that has an abrasive layer and an outer layer, an inner layer, and a thin quilted lining. The abrasive layer covers about ninety percent of the outer layer of the palm section. The palm section has a proximal end, a distal end, and a thumb position. The distal end of the palm section has a tapered front edge. The abrasive layer of the palm section and the top section are positioned one on top of the other. The abrasive layer of the palm section and top section, when in this position, is stitchedly attached together by an inner stitch. The top stitching of the glove forms an interior area that is capable of encasing a hand of a wearer. The top stitching begins near the distal end of the top and palm section. The top stitching ends near the distal end of the top and palm section on an opposite side of the glove. The top stitching forms a reinforced edge around the glove, when the abrasive layers of the top and palm section are exterior the glove. The top stitching allows the top section and the palm section to form a wrist cover. The interior area of the glove is accessible to the hand of the wearer near the wrist cover. The wrist cover forms a generally oblong opening with a pair of side vents formed thereon. The side vents are formed were the top stitching ends. The interior area of the glove has a pair of finger dividers formed by additional top stitching that is extends from the tapered front edge of the top section and palm section to mid-way the glove. The pair of finger dividers separate three of the four fingers that are encased within the glove. The thumb is positioned in a thumb enclosure of the glove while the other fingers are enclosed. Lastly, a flexible closure strap is positioned between the layers of the top section and the palm section of the glove. The closure strap is sealed within the glove near the wrist cover. The closure strap has two ends that are exterior the glove and overlap the vents. The closure strap is capable of allowing the glove to slid onto the hand. The closure strap is capable of allowing the glove to remain secured over the hand throughout the sanding process.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved glove sander which has all of the advantages of the prior art abrasive glove and none of the disadvantages.

It is another object of the present invention to provide a new and improved glove sander which may be easily and efficiently manufactured and marketed.

It is further object of the present invention to provide a new and improved glove sander which is of durable and reliable constructions.

An even further object of the present invention is to provide a new and improved glove sander which is susceptible of a low cost of manufacture with regard to both materials and labor, and which accordingly is then susceptible of low prices of sale to the consuming public, thereby making such glove sander economically available to the buying public.

Still yet another object of the present invention is to provide a new and improved glove sander which provides in the apparatuses and methods of the prior art some of the advantages thereof, while simultaneously overcoming some of the disadvantages normally associated therewith.

Even still another object of the present invention is to provide a glove sander for providing a sanding glove that is formed of flexible material and has sanding material disposed thereabout, and further providing reinforced edges of the glove for allowing the user to sand within crevices.

Lastly, it is an object of the present invention to provide a new and improved glove sander including a glove that has a top section and a palm section. The top section is formed of a flexible fabric that has an abrasive layer and an outer layer, an inner layer, and a lining therebetween. The palm section of the glove is formed of a flexible fabric that has an abrasive layer and an outer layer, an inner layer, and a liner. Included is top stitching that is used to attach the palm section to the top section. The top stitching forms an interior area capable of encasing a hand of a wearer. Lastly, a wrist cover is formed when the top section and the palm section are attached by the top stitching. The wrist cover allows access to the interior area of the glove. The wrist cover has a pair of side vents that are formed near the cover. The pair of side vents are formed when the top stitching ends along the outer edge.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
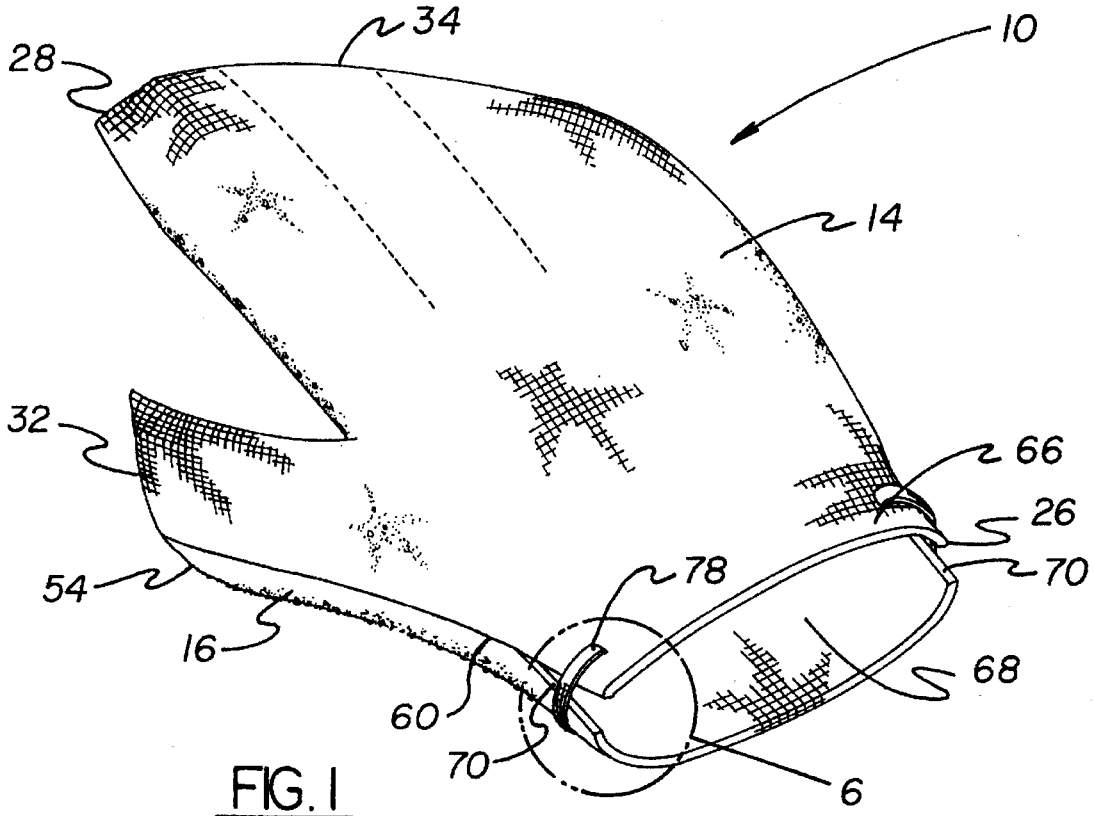
FIG. 1 is a perspective view of the preferred embodiment of the glove sander constructed in accordance with the principles of the present invention.

With reference now to the drawings, and in particular to FIG. 1 thereof, the preferred embodiment of the new and improved glove sander embodying the principles and concepts of the present invention and generally designated by the reference numeral 10 will be described.

The present invention, the glove sander 10 is comprised of a plurality of components. Such components in their broadest context include an outer layer, an inner layer, an abrasive layer, and a strap. Such components are individually configured and correlated with respect to each other so as to attain the desired objective.

Figure 3:
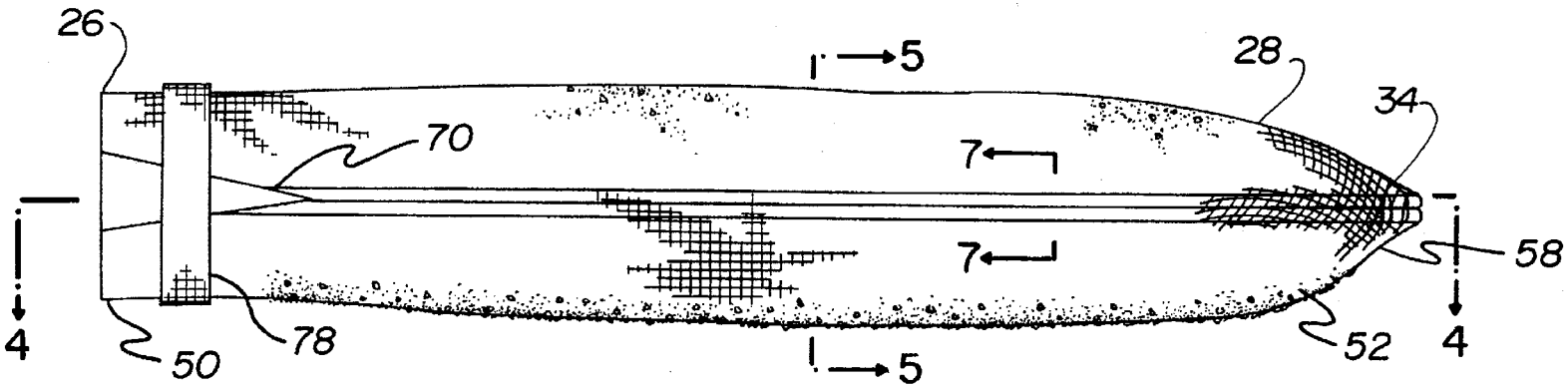
FIG. 3 is a side view of the present invention of FIG. 1.
Figure 5:
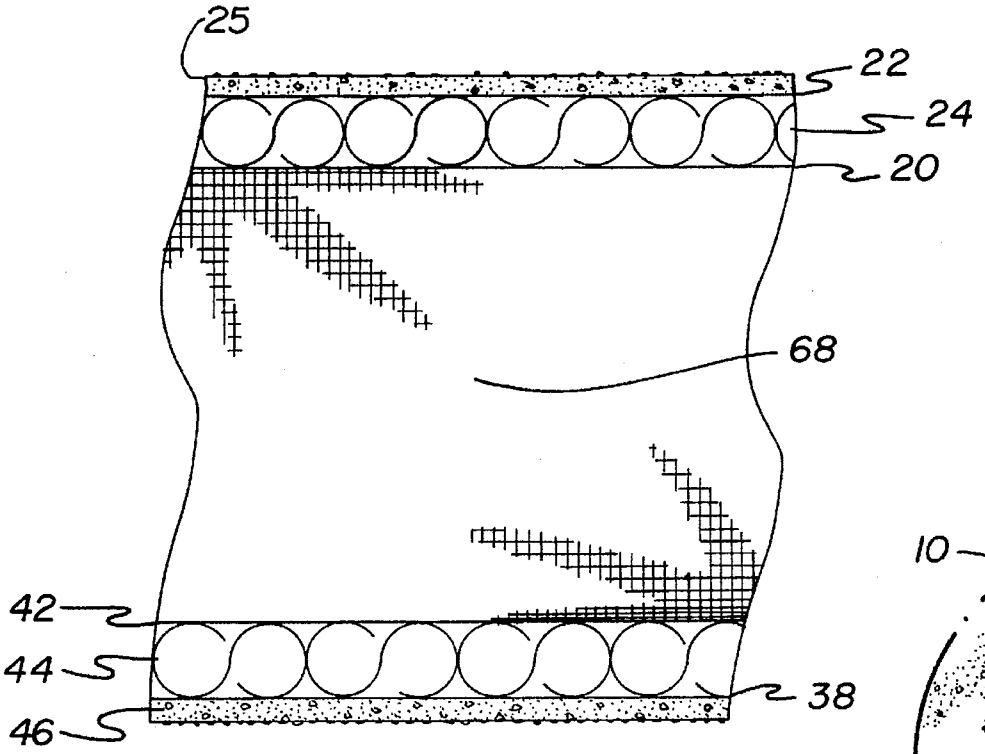
FIG. 5 is a cut-away sectional view of the present invention taken along line 5—5 of FIG. 3.
Figure 6:
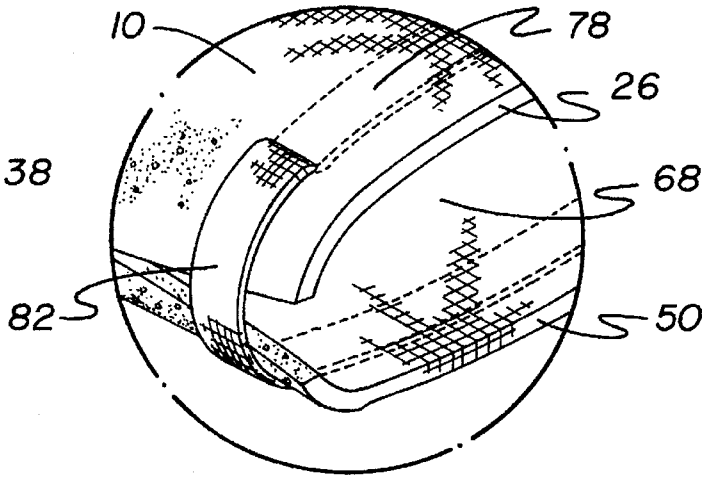
FIG. 6 is an enlarged view of the enclosure strap of the present invention taken at position 6 of FIG. 1.

Specifically, the present invention includes a glove 10 that has top section 14 and a palm section 16, as shown in FIG. 1. The top section of the glove is formed of a flexible fabric. As illustrated in FIG. 5, the fabric has an inner layer 20, an outer layer 22, and a thin quilted lining 24. The outer layer of the fabric of the top section has a top abrasive layer 25 adhered thereto, as seen in FIG. 3. The top abrasive layer covers about ninety percent of the outer layer 22 of the top section. The top section of the glove has a proximal end 26, a distal end 28 and a thumb cover 32. The distal end of the top section has a tapered front edge 34.

Additionally, the palm section 16 of the glove is formed of the same flexible material used to form the top section. The flexible fabric has an outer layer 38, an inner layer 42 and a thin quilted lining 44. The outer layer of the fabric of the palm section has a palm abrasive layer 46 adhered thereto. The palm abrasive layer, as shown in FIG. 3, covers about ninety percent of the outer layer of the palm section. The palm section has a proximal end 50, a distal end 52, and a thumb portion 54. The distal end of the palm section has a tapered front edge 58.

The abrasive layer of the top section and the palm section are identical. Each abrasive layer is any commercially available abrasive fabric that can be readily adhere to the outer layer of the top and palm section of the glove. The abrasive layer may come in grades ranging from extra fine to extra coarse.

The top section and the palm section are stitchedly attached. The tapered front edge 34 of the top section, and the tapered front edge 58 of the palm section are attached with a top stitch 60. The top stitch, as shown in FIG. 7, allows the abrasive layer of the top and palm section to extend around all edges of the glove.

Figure 7:
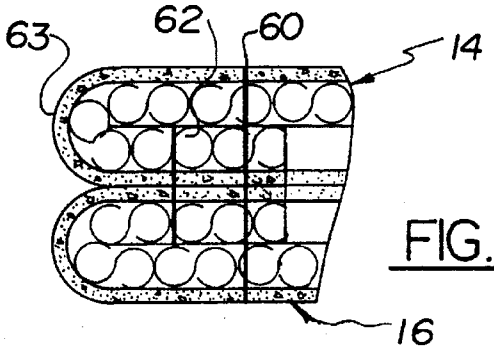
FIG. 7 is a fragmentary view taken along line 7—7 of FIG. 3.

As best illustrated in FIG. 7, an inner stitch 62 connects the top section and the palm section. When the inner stitch is made, the top abrasive layer and the palm abrasive layer are positioned one on top of the other. The inner stitch gives the glove its initial shape. The glove is then turned inside out, in order to allow each abrasive layer to be exterior. Then, the glove is top stitched to form a reinforced edge 63 on each section.

The top stitching 60, of the glove, forms an interior area 64 that is capable of encasing a hand of a wearer. The top stitching begins near the distal end of the top and palm section. The top stitching ends near the distal end of the top and palm section on an opposite side of the glove. The top stitching allows the top section and the palm section to form a wrist cover 66.

Figure 4:
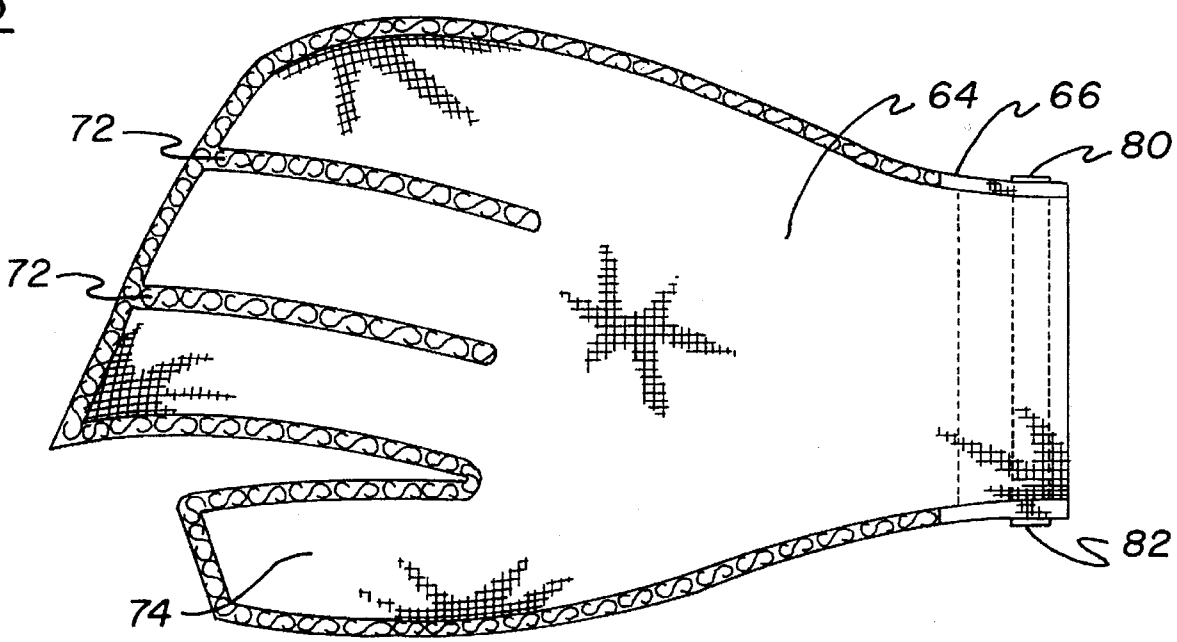
FIG. 4 is a cross sectional view of the present invention taken along line 4—4 of FIG. 3.

The interior area 64 of the glove 10 is accessible to the hand of the wearer near the wrist cover 66. The interior area of the glove has a surface area that is formed from the inner layer of the top section and the palm section. The wrist covering forms a generally oblong opening 68, as shown in FIG. 1. The opening has a pair of side vents 70 that are formed where the top stitching begins and ends. The interior area of the glove has a pair of finger dividers 72, as shown in FIG. 4. The finger dividers are formed by additional top stitching that extends from the tapered front edges 34 and 58, of the top and palm section to mid-way the glove. The pair of finger dividers are capable of separating three of the four fingers encased within the glove, while the thumb finger is positioned in a thumb enclosure 74 of the gloves. The finger dividers and the thumb enclosure are non-restrictive and allow the fingers to open and close with a normal motion.

As best illustrated in FIG. 3, a flexible closure strap 78 is provided. The closure strap is positioned between the layers of the top section 14 and the palm section 16 of the glove. The closure strap is sealed within the glove near the wrist cover 66, as shown in FIG. 4. The closure strap has two ends 80 and 82 that are exterior the glove. The two ends of the closure strap overlap the vents 70. The closure strap allows the gloves to slid onto the hand. The closure straps are capable of securing the glove over the hand during the sanding activity.

Figure 2:
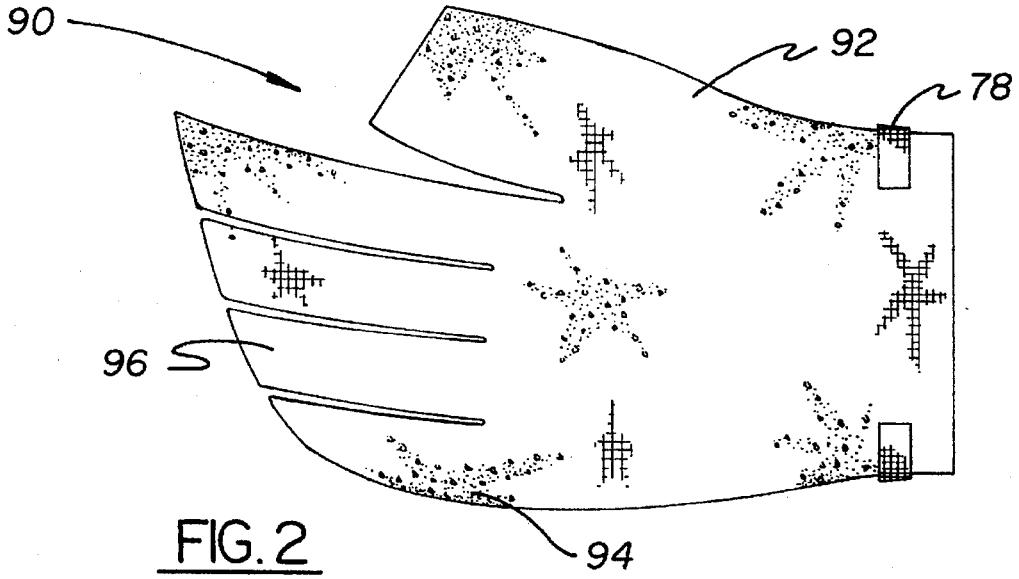
FIG. 2 is an alternative perspective view of a glove sander constructed in accordance with the principles of the present invention.

Lastly, FIG. 2 shows an alternative embodiment 90 of the present invention. In the alternative embodiment, the glove has sections for accommodating five fingers of a hand. The glove has a bottom section 92 that is formed of a flexible fabric. The flexible fabric is identical to the material that is depicted in FIG. 5. The glove of the alternative embodiment has an abrasive layer 94 over an outer layer. Also, in the alternative embodiment, the abrasive layer covers the entire outer layer of the glove. Top stitching is used on this embodiment to form an interior area that can encase the hand and the fingers of the wearer. The top stitching traverses finger projections 96 in a manner that causes the finger projections to be separated one from another.

Like the glove of FIG. 1, the top stitching allows the top section and a palm or bottom section to form a wrist cover. The wrist cover of the alternative embodiment also has a flexible closure strap positioned between. Additionally, the top stitching allows each edge of the finger projections to have reinforced edges like the reinforced edge 63 of FIG. 1.

The present glove sanders are gloves that may be in the form of mitts, finger gloves, or a finger glove with a thumb projection and pockets for the remaining four fingers. The glove sander is simple to use and makes sanding jobs of a variety of material easy and quick. The present invention may be used in production lines, on job sites, or in the home workshop. The glove generally has a two layer construction that consists of a durable soft inner lining which is bound between an outer layer and an inner layer. A top section and palm section of the glove is covered ninety percent, with a sandpaper fabric. The sandpaper fabric may range from extra fine to extra coarse. The glove itself may come in a variety of sizes and colors. The glove of the present invention has a tapered end at the tips of what would be the fingers for allowing sanding in crevices. The glove further has a vent opening on each side. The vent opening allows small amounts of air to circulate in and out of the glove for cooling. The vent opening has an elastic strap cover. The elastic strap cover extends through the wrist cover or the glove to give the wrist area tightness for a secure fit around the wrist of the hand. The elastic closure also allows the hand to easily slid past the wrist cover and into the interior area of the glove.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A glove sander for smoothing the exterior surfaces of any sandable material comprising in combination:

a glove having a top section and a palm section;

the top section of the glove being formed of a flexible fabric having a top abrasive layer, and an inner layer and an outer layer with a thin quilted lining therebetween, the top abrasive layer covering about 90 percent of the outer layer of the top section, the top section of the glove having a proximal end, a distal end, and a thumb cover, the distal end of the top section having a tapered front edge;

the palm section of the glove being formed of flexible fabric having a palm abrasive layer, and an outer layer and an inner layer with a thin quilted lining therebetween, the palm abrasive layer covering about 90 percent of the outer layer of the palm section, the palm section having a proximal end, a distal end and a thumb position, the distal end of the palm section having a tapered front edge, the abrasive layer of the top section and the palm section being positioned one on top of the other and being stitchedly attached thereto with an inner stitch;

a top stitching beginning near the distal end of the top and palm section, the top stitching ending near the distal end of the top and palm section on an opposite side of the glove, the top stitching being capable of forming a reinforced edge around the glove when the abrasive layers of the top and palm section are exterior the glove, the top stitching of the glove forms an interior area capable of encasing a hand of a wearer, the top stitching allows the top section and the palm section to from a wrist cover;

the interior area of the glove being accessible to the hand of the wearer near the wrist cover, the wrist cover forming a generally oblong opening with a pair of side vents being formed where the top stitching begins and ends, the interior area of the glove having a pair of finger dividers formed by additional top stitching being extended from the tapered front edge of the top section and palm section to midway of the glove, the pair of finger dividers being capable of separating three of the four fingers encased within the glove, while the thumb is positioned in a thumb enclosure of the glove; and a flexible closure strap being positionable between the layers of the top section and the palm section of the glove, the closure strap being sealed within the glove near the wrist cover, the closure strap having two ends being exterior the glove and overlapping the vents, the closure strap capable of allowing the glove to slide onto the hand while allowing the glove to remain around the hand, the closure strap being capable of securing the glove onto the hand during the sanding activity.

2. A glove sander comprising:

a glove being sectional for accommodating five fingers of a hand, the glove having a top section and a bottom section;

the top section of the glove being formed of a flexible fabric having an abrasive layer and an outer layer, an inner layer and a thin quilted lining therebetween, the top section of the glove having a proximal end, a distal end and finger projections therebetween, the abrasive layer covering 100 percent of the outer layer of the finger projections, the distal end of the top section having a reinforced edge along each finger of the glove;

the bottom section of the glove being formed of flexible fabric having an abrasive layer and an outer layer, an inner layer and a thin quilted lining therebetween, the bottom section having a proximal end, a distal end and a palm portion with finger projections extending therefrom, the abrasive layer covering 100 percent of the outer layer of the finger projections, the distal end of the bottom section having a reinforced edge, the bottom section being stitchedly attached to the top section with a top stitching along an outer edge;

the top stitching of the glove forms an interior area capable of encasing the hand and fingers of a wearer, the top stitching beginning near the distal end of the top and bottom section, the top stitching traversing the finger projections and ending near the distal end of the top and bottom section, the top stitching allows the top section and the bottom section to form a wrist cover;

the interior area of the glove being accessible to the hand of the wearer near the wrist cover, the wrist cover forming a generally oblong opening with a pair of side vents being formed where the top stitching begins and ends; and a flexible closure strap being positionable between the layers of the top section and the palm section of the glove, the closure strap being sealed within the glove near the wrist cover, the closure strap having two ends being exterior the glove and overlapping the vents, the closure strap capable of allowing the glove to slide onto the hand while allowing the glove to remain around the hand.

3. A glove sander comprising:

a glove having a top section and a palm section, the top section being formed of a flexible fabric having abrasive layer and an outer layer, an inner layer and a lining therebetween, the palm section of the glove being formed of a flexible fabric having an abrasive layer and an outer layer, an inner layer and a lining therebetween;

a top stitching being used to attached the palm section to the top section, the top stitching forming an interior area being capable of encasing a hand of a wearer, and the top stitching forming a reinforced edge around the glove;

the interior area of the glove having a pair of finger dividers formed by separate additional top stitching being extended from the top end of the top section to midway the glove, and the pair of finger dividers being capable of separating three of the four fingers encased within the glove, while the thumb being positioned in a thumb enclosure of the glove;

a wrist cover being formed when the top section and the palm section are attached by the top stitching, the wrist cover allowing access to the interior area of the glove, the wrist cover having a pair of side vents being formed near the cover, the pair of side vents being formed where the top stitching ends along the outer edge; and a closure strap having two ends being exterior the glove and overlapping the vents, and the closure strap capable of allowing the glove to slide onto the hand while allowing the glove to remain around the hand.

* * * * *